US008152651B2

(12) United States Patent
Roach

(10) Patent No.: US 8,152,651 B2
(45) **Date of Patent: *Apr. 10, 2012**

(54) IRON GOLF CLUB WITH IMPROVED MASS PROPERTIES AND VIBRATION DAMPING

(75) Inventor: Ryan L. Roach, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/093,708

(22) Filed: Apr. 25, 2011

(65) Prior Publication Data

US 2011/0201449 A1 Aug. 18, 2011

Related U.S. Application Data

(63) Continuation of application No. 12/622,178, filed on Nov. 19, 2009, now Pat. No. 7,938,738, which is a continuation of application No. 11/469,621, filed on Sep. 1, 2006, now Pat. No. 7,621,822.

(51) Int. Cl.
*A63B 53/04* (2006.01)

(52) U.S. Cl. ..... 473/329; 473/332; 473/349; 473/350

(58) Field of Classification Search ..... 473/287–292, 473/324–350

See application file for complete search history.

(56) References Cited

U.S. PATENT DOCUMENTS

| | | | |
|---|---|---|---|
| 2,846,228 | A | 8/1958 | Reach |
| 3,970,236 | A | 7/1976 | Rogers |
| 4,398,965 | A | 8/1983 | Campau |
| 4,792,139 | A | 12/1988 | Nagasaki et al. |
| 5,184,823 | A | 2/1993 | Desboilles et al. |
| 5,290,036 | A | 3/1994 | Fenton et al. |
| 5,431,396 | A | 7/1995 | Shieh |
| 5,492,327 | A | 2/1996 | Biafore |
| 5,540,436 | A | 7/1996 | Boone |
| 5,564,705 | A | 10/1996 | Kobayashi et al. |
| 5,593,356 | A | 1/1997 | Takeda |
| 5,599,243 | A | 2/1997 | Kobayashi |

(Continued)

FOREIGN PATENT DOCUMENTS

JP 4-51973 6/1990

(Continued)

OTHER PUBLICATIONS

"Momentum Sign XP Iron", Kokusai Kogyo Company, Ltd., Golf Department Feb. 2005.

(Continued)

*Primary Examiner* — Sebastiano Passaniti

(74) *Attorney, Agent, or Firm* — Mark S. Leonardo; Brown Rudnick LLP

(57) ABSTRACT

A golf club is provided having improved playing characteristics based upon a multiple material construction. This construction involves a club body in combination with a face insert that defines a hollow channel therebetween. This hollow channel is substantially filled with a heterogeneous viscoelastic material, such as urethane containing tungsten powder. The heterogeneous material is formulated such that the density of the material is varied based upon the location of that material within the hollow channel of the golf club head. In particular, lower density portions of the material are located near the top of the club head, and higher density portions are located near the bottom or sole of the club head. This moves the center of gravity of the club head downward and rearward, yielding improved feel and improved weight distribution and enhancing performance of the club.

20 Claims, 2 Drawing Sheets

U.S. PATENT DOCUMENTS

| | | | |
|---|---|---|---|
| 5,616,088 | A | 4/1997 | Aizawa et al. |
| 5,669,826 | A | 9/1997 | Chang et al. |
| 5,772,527 | A | 6/1998 | Liu |
| 5,833,551 | A | 11/1998 | Vincent et al. |
| 5,993,329 | A | 11/1999 | Shieh |
| 6,045,456 | A | 4/2000 | Best et al. |
| 6,077,171 | A | 6/2000 | Yoneyama |
| 6,083,118 | A | 7/2000 | Martins et al. |
| 6,206,790 | B1 | 3/2001 | Kubica et al. |
| 6,440,010 | B1 | 8/2002 | Deshmukh |
| 6,443,857 | B1 | 9/2002 | Chuang |
| 6,592,469 | B2 | 7/2003 | Gilbert |
| 6,683,152 | B2 | 1/2004 | Wu et al. |
| 6,688,989 | B2 | 2/2004 | Best |
| 6,743,117 | B2 | 6/2004 | Gilbert |
| 6,773,361 | B1 | 8/2004 | Lee |
| 6,835,144 | B2 | 12/2004 | Best |
| 6,875,124 | B2 | 4/2005 | Gilbert et al. |
| 6,902,495 | B2 | 6/2005 | Pergande et al. |
| 6,976,924 | B2 | 12/2005 | Gilbert et al. |
| 6,991,559 | B2 | 1/2006 | Yabu |
| 7,070,513 | B2 | 7/2006 | Takeda et al. |
| 7,281,989 | B2 | 10/2007 | Hou et al. |
| 7,303,485 | B2 | 12/2007 | Tseng |
| 7,303,486 | B2 | 12/2007 | Imamoto |
| 7,316,623 | B2 | 1/2008 | Imamoto |
| 7,481,718 | B2 | 1/2009 | Soracco et al. |
| 7,530,902 | B2 | 5/2009 | Nakamura |
| 7,588,502 | B2 | 9/2009 | Nishino |
| 7,621,822 | B2 | 11/2009 | Roach |
| 7,938,738 | B2 | 5/2011 | Roach |
| 2004/0166959 | A1 | 8/2004 | Chen |
| 2005/0277485 | A1 | 12/2005 | Hou et al. |
| 2006/0052184 | A1 | 3/2006 | Soracco et al. |
| 2007/0129162 | A1 | 6/2007 | Pan et al. |

FOREIGN PATENT DOCUMENTS

| | | |
|---|---|---|
| JP | 3032837 | 10/1996 |
| JP | 2001-37925 | 2/2001 |
| JP | 2001-79123 | 3/2001 |
| JP | 2001-95959 | 4/2001 |
| JP | 2003-334267 | 11/2003 |
| JP | 2004-313777 | 3/2004 |
| JP | 2006-129936 | 11/2004 |
| JP | 3112038 | 4/2005 |
| WO | WO 99/20358 | 4/1999 |

OTHER PUBLICATIONS

"Iron, Driver, Fairwaywood, Ladies", Three Wings Assocites, Feb. 2005.

Japanese Office Action, First re JP Pat. App. No. 2007-225117, dated Feb. 2, 2010 (with English translation).

Japanese Office Action, First re JP Pat. App. No. 2007-225117, dated Oct. 26, 2010 (with English translation).

Japanese Office Action / Decision to Decline, re JP Pat. App. No. 2007-225117, dated Apr. 25, 2011.

Japanese Office Action / Final Rejection, re JP Pat. App. No. 2007-225117, dated Apr. 25, 2011.

U.S. Office Action re U.S. Appl. No. 12/622,178, dated May 5, 2010.

U.S. Notice of Allowance re U.S. Appl. No. 12/622,178, dated Jan. 19, 2011.

IRON GOLF CLUB WITH IMPROVED MASS PROPERTIES AND VIBRATION DAMPING

CROSS-REFERENCE TO RELATED APPLICATIONS

This is a continuation of U.S. patent application Ser. No. 12/622,178, filed Nov. 19, 2009, which is a continuation of U.S. patent application Ser. No. 11/469,621, filed Sep. 1, 2006, now U.S. Pat. No. 7,621,822, which are incorporated herein by reference in their entireties.

FIELD OF THE INVENTION

The present invention relates to golf clubs and more specifically to golf clubs with improved mass properties and vibration damping.

BACKGROUND OF THE INVENTION

Perimeter weighting in iron-type golf clubs distributes non-essential mass of the iron towards the perimeter, reducing the effects that off-center hits have on the golf club and producing more accurate and consistent golf ball trajectories. Perimeter weighting is achieved by creating a cavity in the back of the golf club opposite the face or hitting surface. The material weight removed to create this cavity is redistributed around the perimeter of the golf club head. In general, larger cavity volumes correspond to increased amounts of mass distributed around the perimeter.

Removing material from the rear of the club head, however, reduces the thickness of the club face. Since the club face is the hitting surface, the club face cannot be so thin that the strength of the club face surface is not sufficient to withstand the stress resulting from a golf ball striking the club face. Reducing the thickness of the club face may also increase vibrations upon impact. These vibrations may cause bad feel to the user.

There are various examples of secondary material incorporation into iron golf club heads for vibration damping. Some of these examples have provided the additional benefit of displacing weight to the perimeter of the club head so as to increase the club head's rotational moment or inertia (MOI). These vibration dampers, however, have involved multiple materials such as in constrained layer damping, or they have been positioned across the entire face or isolated to the lower area of the club head. In addition, most conventional club heads are made of one homogenous material and the secondary damping materials incorporated into the golf club head are also homogenous. This type of construction, however, imposes design constraints on the head configuration, thus limiting the opportunity to produce an iron with forgiving play characteristics while at the same time maintaining a traditional sized head. The use of one homogenous material also may limit the placement of the head's center of gravity.

Therefore, a golf club head is desired that utilizes a secondary material to improve vibration damping while improving the placement of the center of gravity and MOI of the club head to improve golf ball launch conditions and to improve the feel of the club to the user.

SUMMARY OF THE INVENTION

The present invention is directed to a golf club having improved playing characteristics based upon a multiple material construction. This construction involves a club body portion having a face insert. There is a hollow area or channel between the face insert and the body portion after the insertion of the face insert. This hollow channel is substantially filled with a heterogeneous viscoelastic material, such as urethane or natural or synthetic rubber containing additives or fillers to modify the material's density. Suitable fillers include high density fillers and low density fillers. High density fillers include, but are not limited to, metal powders such as tungsten powder. Low density fillers include, but are not limited to, micro-spheres or voids created by foaming agents. The fillers are partially incorporated into the viscoelastic material so that a lower density portion of the material is located near the top or crown of the club head and a higher density portion is located near the bottom or sole of the club head. This moves the center of gravity of the club head downward and rearward while providing vibration damping. The shape and volume of the channel can also be varied to further modify the weight distribution in the golf club head. The incorporation of this secondary or damping material provides improved feel, improved weight distribution, and enhanced club performance.

For example, in one embodiment, the heterogeneous composite material has at least a first region having a first density and disposed in the channel toward the top line of the golf club body and a second region having a second density and disposed in the channel toward the sole of the body. The second density is greater than the first density, thereby lowering the center of gravity while providing vibration damping. When the channel is in the shape of a generally annular or elliptical ring running substantially parallel to the perimeter of the body of the golf club head, the first region of the composite material is disposed in a first portion of the channel adjacent the top line, and the second region of the composite material is disposed in a second portion of the channel adjacent the sole. This annular or elliptical ring can be arranged with uniform dimensions, or the dimensions can be varied to further affect weight distribution. For example, the annular channel can have a first width disposed adjacent the top line and a second width disposed adjacent the sole, such that the second width is greater than the first width. Similarly, the annular channel further can have a first depth in the first width area and a second depth in the second width area, such that the second depth is greater than the first depth. Therefore, a greater amount or volume of heterogeneous composite material can be placed toward the sole and rearward in the club head.

The channel between the club body portion and the face insert may comprise discrete portions, with at least one portion containing lower density viscoelastic material and at least another portion containing a higher density viscoelastic material.

DETAILED DESCRIPTION

Figure 1:
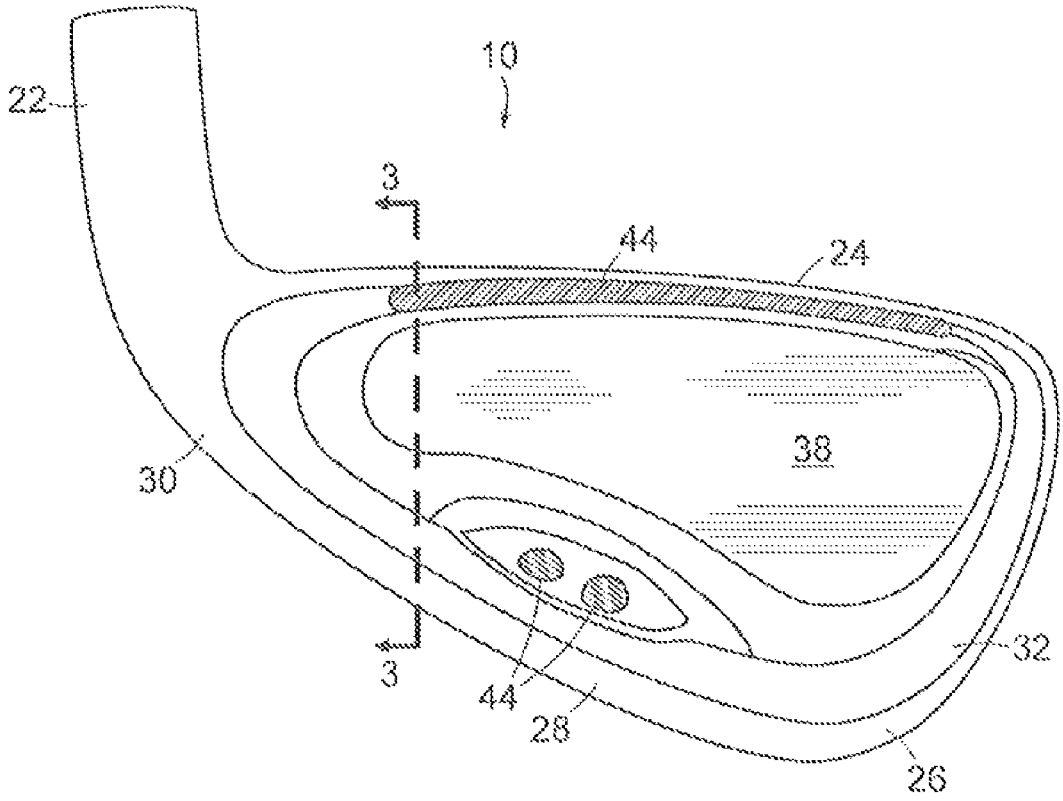
FIG. 1 is a first perspective rear view of an embodiment of the golf club heads of the present invention.
Figure 2:
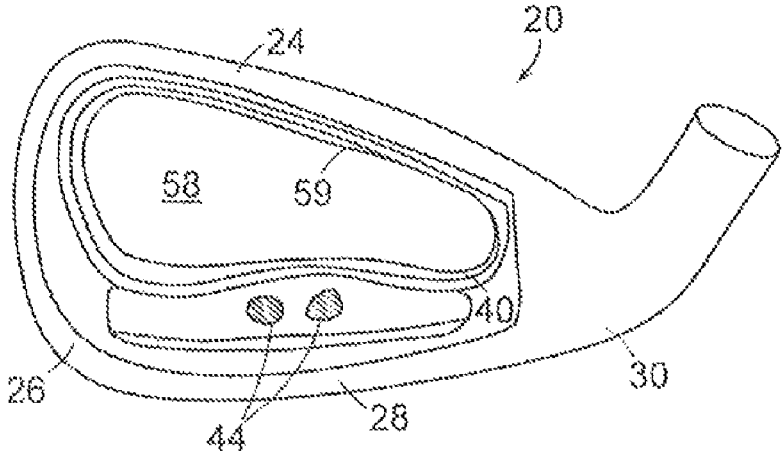
FIG. 2 is a perspective front view of the club body portion without the hitting face.

Referring now to the accompanying figures, exemplary embodiments of the golf club head 10 in accordance with the present invention include body portion 20 (FIGS. 1 and 2) connected to hosel 22. Hosel 22 is adapted to receive a shaft (not shown). The club head 20 is preferably cast or forged from suitable material such as stainless steel, carbon steel or titanium. Body portion 20 includes crown 24, toe 26, sole 28 and heel 30 that form the perimeter of body portion 20. Hosel 22 extends generally from heel 30 of body portion 20. Club head 10 is preferably a cavity back club; therefore, body portion 20 includes rear perimeter 32 extending from the back of the club head and running along its perimeter. The portion of perimeter weight 32 along sole 28 is larger/thicker to move the center of gravity downward and rearward. Arrangements for perimeter weighting are generally known in the art.

Figure 3:
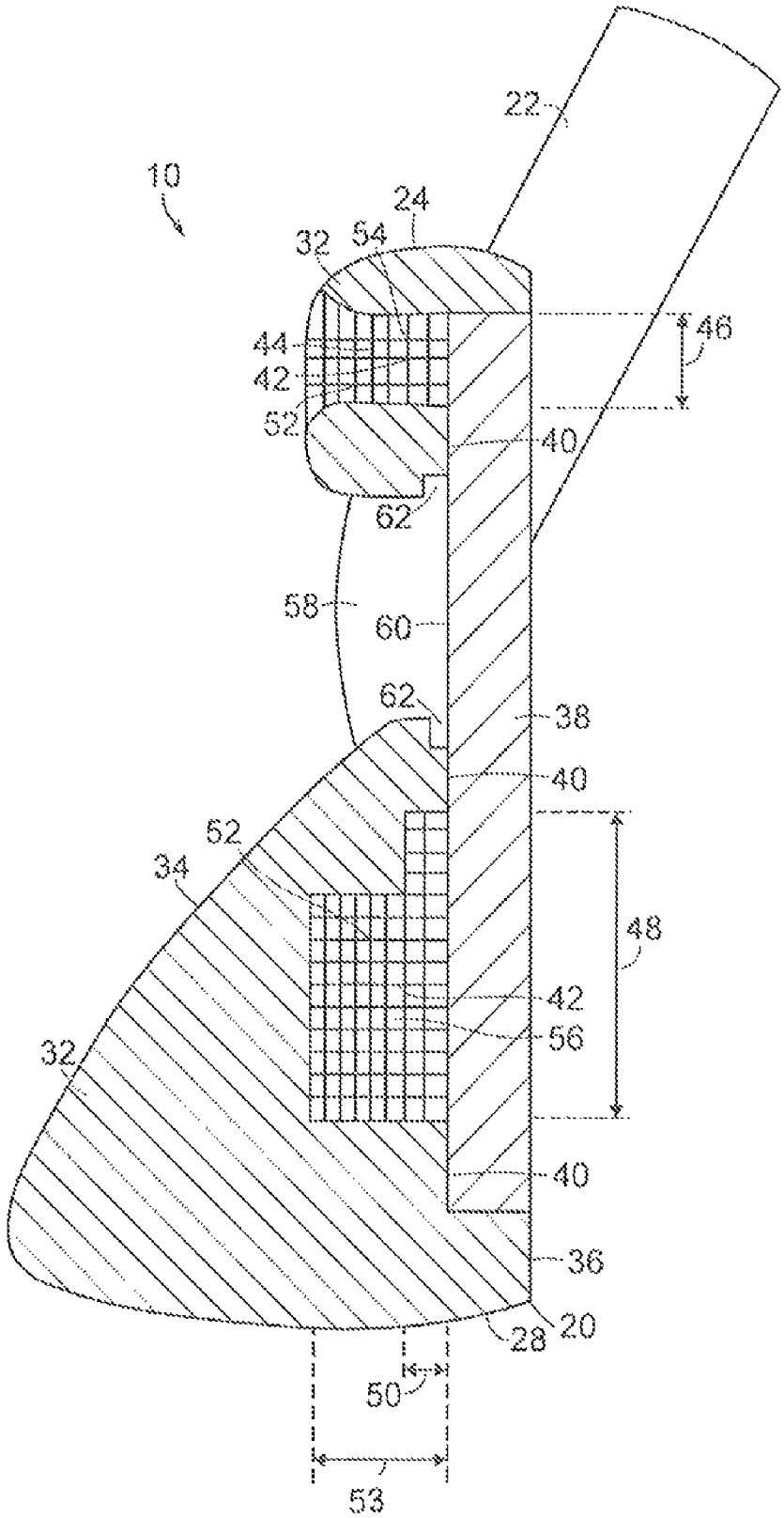
FIG. 3 is a cross-sectional view through line 3-3 of FIG. 1.

As is shown in FIG. 3, club head 10 also includes face insert 38 attached to the front 36 of body portion 20. Suitable materials for face insert 38 include, but are not limited to, stainless steel, preferably a high-strength steel material, and non-steel materials such as titanium and metal matrix composites (MMC). Face insert 38 forms the club face or hitting surface of club head 10. Suitable methods for attaching face insert 38 to body portion 20 include, but are not limited to, welding, swaging, press fitting, hot isostatic pressing and attachment using bonding agents or adhesives. In one embodiment, face insert 38 is attached to body portion 20 by laser-welding face insert 38 to cast body portion 20 of the golf club. Face insert 38 is in contact with and supported by body portion 20 at one or more support 40. In other areas, face insert 38 is spaced from body portion 20 to define channel 42 disposed between at least a portion of face insert 38 and body portion 20. In one embodiment, channel 42 can be completely enclosed between body portion 20 and face insert 38. Channel 42 is adapted to receive a secondary or damping material.

In one embodiment, hollow or channel 42 is not completely enclosed but is arranged to have one or more open areas or openings 44 to the back cavity. Openings 44 can be positioned near top line 24 or sole 28, and can be an elongated channel or circular shape. These open areas or openings allow any secondary material disposed in the channel to be visible to the user. Channel 42 can be formed as a uniform channel or can vary in size and shape. In one embodiment, channel 42 forms a generally annular shape running substantially parallel to rear perimeter 32. In one embodiment, channel 42 between face insert 38 and cast body 20 extends from about 45° to about 360° around the perimeter of the face of the golf club. Channel 42 may comprise several discrete portions. In one embodiment, the width of this annular channel is varied. For example, annular channel 42 can have first width 46 disposed adjacent top line 24 and second width 48 disposed adjacent sole 28. In one embodiment, second width 48 is greater than first width 46. In addition, the depth of the annular channel can be varied. For example, channel 42 can include first depth 50 and areas of second depth 53, such as at openings 44 as shown in the cross-sectional view of FIG. 3, in first width 46 area or other areas disposed toward top line 24 and second depth 51 in the second width 48 area. Second depth 53 is greater than first depth 50. Varying the depth and width of channel 42 varies the volume of channel 42 and the amount of channel 42 in contact with face insert 38.

In order to damp vibration and improve weight distribution, heterogeneous composite material 52 is disposed in at least a portion of channel 42. Composite material 52 is heterogeneous in that the composition and density of composite material 52 is varied depending on its location within channel 42. In one embodiment, heterogeneous composite material 52 is disposed in the entire channel 42. In general, the composition, e.g., the density, of composite material 52 is varied in order to shift more weight downward and rearward, thereby moving the center of gravity of golf club head 10 downward and rearward as well. Therefore, the portion of composite material 52 located toward crown 24 is formulated to have lower density, and the portion of composite material located toward sole 28 is formulated to have higher density. The volume and configuration of channel 42 can also be used to improve the weight distribution. For example, the channel is arranged to be larger or to extend farther rearward in areas located near the sole of the club head. In one embodiment, heterogeneous composite material 52 contains first region 54 having a first density and disposed in channel 42 toward crown 24 of body portion 20. The composite material also includes second region 56 containing second density and disposed in channel 42 toward sole 28 of body portion 20. The second density is greater than the first density.

Suitable methods for introducing or attaching the composite damping material to the channel include, but are not limited to, pouring or injecting the damping material into the hollow area after face insert 42 is welded to the body, for example through openings in the back of the body portion. The face insert can also be crimped into place, allowing the heterogeneous composite material to be molded separately and placed into the cast body before crimping, providing the benefit of ease of manufacture. The molded material can be press fit or attached using a bonding agent such as glues or epoxies. Alternatively, the composite material can be poured or injected into the hollow area before face insert 42 is installed, as with laser-welded attachments.

In a preferred embodiment, channel 42 is arranged with a generally annular shape that runs substantially parallel to the perimeter of body portion 20. In this arrangement, first region 54 of composite material 52 is disposed in a first portion of channel 42 disposed adjacent top line 24, and second region 56 of composite material 52 is disposed in a second portion of channel 42 adjacent sole 28. In this embodiment, composite material 52 substantially fills the entire channel 42, providing contact with face insert 38 throughout the channel area.

The heterogeneous material is selected to enhance weight distribution and vibration damping. In one embodiment, the heterogeneous composite material includes a viscoelastic material. Suitable viscoelastic materials include, but are not limited to, polyurethane, natural or synthetic rubbers, other elastomers, epoxies, and combinations thereof. Preferably, the heterogeneous composite material includes a polyurethane made from a polyol and a polyisocyanate. In general, any viscoelastic material can be used. If the heterogeneous material is to be poured or injected, the material should have a low viscosity, minimal shrinkage rate and quick set-up time to allow for ease of manufacturing. Suitable materials include silicone rubbers such as RTV-627, which is commercially available from MG Chemicals of Surrey, B.C., Canada.

Changes in the weight or density of the heterogeneous composite material to achieve heterogeneity are achieved by adding fillers to the viscoelastic materials. These fillers can either decrease, e.g., glass beads, micro-spheres or voids created by foaming agents, or increase, e.g., metal powders, the density of the composite material. Suitable fillers include, but are not limited to, carbon graphite, metal fibers, zinc oxide, barium sulfate, calcium oxide, calcium carbonate and silica, as well as the other well known corresponding salts and oxides thereof, foaming agents, glass spheres, metals and combinations thereof. Preferably the additive or filler is a metal powder. Suitable metal powders include, but are not limited to, tungsten, magnesium, titanium and aluminum. Preferably, the metal powder has high density such as tungsten powder, producing, for example, a tungsten-filled silicone rubber. The amount of filler is selected based upon the desired density distribution requirements. In one embodiment; upper portion 54 contains un-filled viscoelastic material and lower portion 56 contains high density metal-filled viscoelastic material.

Additional components or additives that can be added to the heterogeneous composite material include UV stabilizers and other dyes, as well as optical brighteners and fluorescent pigments and dyes. Such additional ingredients may be added in any amounts that will achieve their desired purpose.

As shown in the figures; club body portion 20 also includes central opening 58 having perimeter 59 that generally parallels the perimeter of body portion 20. Opening 58 exposes back surface 60 of face insert 38 to the back of the club head. Adjacent perimeter 59 of opening 58 is contact surface 40 that is in contact with face insert 38. In one embodiment, step or space 62 runs along perimeter 59 and is spaced from contact surface 40, as shown in FIG. 3. This provides a gap that can be used to inject the heterogeneous composite materials 52.

Exemplary embodiments of golf clubs having the face insert, cast body and heterogeneous viscoelastic material in accordance with the present invention provide improved feel due to the damping provided by viscoelastic material 52 confined in channel 42 disposed between body portion 20 and face insert 38. The damping material is in contact with and is located directly behind the hitting area, as well as around the perimeter of the face, where significant vibration could occur. By removing weight from the topline and upper perimeter and replacing it with lighter viscoelastic material and by adding high density filler to the viscoelastic material near the sole, the center of gravity is lowered. Arrangements in accordance with the present invention can be used with various types of golf clubs includes irons, putters and wedges.

Golf clubs in accordance with exemplary embodiments of the present invention allow for damping material to be placed around the entire perimeter of the face, if desired, or to be isolated to specific areas of the club head such as only the top line or only the high or low toe area. In addition to the mass property and vibration damping benefits, the channel may have a unique cosmetic appearance if part of the channel is left exposed. The exposed area would create a window or series of windows through which the viscoelastic material can be seen.

Alternatively, the density of the damping material remains substantially the same throughout, and the damping material is made from a composite material, such as a viscoelastic material with fillers, as described in details above. In one example, the viscoelastic material comprises polyurethane and the filler comprises low density micro-spheres or high density metal powders. The option of using low density or high density fillers provides golf club designers with additional degrees of freedom to locate the center of gravity at desired locations, to size the sweet spot of the golf clubs, and to adjust MOI as desired.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head, comprising:

a body portion defining a perimeter weight and constructed of a first material;

a hitting face disposed at the front of the body portion;

a channel defined by a portion of the perimeter weight, at least a portion of the channel being fully circumscribed by the perimeter weight and a back surface of the face;

at least one opening in the body portion adjacent to the channel, the opening located at a back of the body portion;

wherein a part of the channel is not exposed by the at least one opening;

said at least one opening comprising a first opening positioned near a top line of the body portion and a second opening positioned near a sole of the body portion;

a second material disposed in at least a portion of the channel, wherein the second material is different from the first material;

a third material disposed in at least a portion of the channel, wherein the third material is different from the first and second materials; and wherein said second material is exposed by said first opening, and said third material is exposed by said second opening.

2. The golf club head of claim 1, wherein the second material is disposed in only an upper portion of the entire channel near the top line of the body portion.

3. The golf club head of claim 1, wherein the third material is disposed in only a lower portion of the entire channel near the sole of the body portion.

4. The golf club head of claim 1, wherein the third material has a greater density than the first and second materials.

5. The golf club head of claim 1, wherein the third material is a heterogeneous composite material comprising of tungsten.

6. The golf club head of claim 1, wherein the second material has a lesser density than the first and third materials.

7. The golf club head of claim 1, wherein the second material comprises a viscoelastic material.

8. The golf club head of claim 1, wherein the first opening is an elongate channel.

9. The golf club head of claim 1, wherein the second opening is an elongate channel.

10. The golf club head of claim 1, wherein the second and third materials comprise UV stabilizers.

11. A golf club head, comprising:

a body portion defining a perimeter weight and constructed of a first material;

a hitting face disposed at the front of the body portion;

a channel defined by a portion of the perimeter weight, at least a portion of the channel being fully circumscribed by the perimeter weight and a back surface of the face;

at least one opening in the body portion adjacent to the channel, the opening located at a back of the body portion;

said at least one opening comprising a first opening positioned near a top line of the body portion and a second opening positioned near a sole of the body portion;

a second material disposed in at least a first portion of the channel, wherein the second material is different from the first material, wherein said second material is exposed by said second opening;

a second portion of the channel, wherein no material is disposed within the second portion of the channel creating a hollow space, wherein the hollow space is exposed by said first opening.

12. The golf club head of claim 11, wherein the second material is disposed in only a lower portion of the entire channel near the sole of the body portion.

13. The golf club head of claim 11, wherein the second material has a greater density than the first material.

14. The golf club head of claim 11, wherein the second material is a heterogeneous composite material comprising of tungsten.

15. The golf club head of claim 11, wherein the second material comprises a viscoelastic material.

16. The golf club head of claim 11, wherein the first opening is an elongate channel.

17. The golf club head of claim 11, wherein a part of the channel is not exposed by the at least one opening.

18. A golf club head, comprising:

a body portion defining a perimeter weight and constructed of a first material;

a hitting face disposed at the front of the body portion;

a channel defined by a portion of the perimeter weight, at least a portion of the channel being fully circumscribed by the perimeter weight and a back surface of the face;

a second material disposed in at least a portion of the channel, wherein the second material is a heterogeneous composite material and is different than the first material;

a step running along the perimeter weight, spaced from the back surface of the face to produce a gap; and an opening through the gap, wherein the opening is positioned near a sole of the body portion and configured to allow the injection of the second material through the gap and into at least a portion of the channel.

19. The golf club head of claim 18, further comprising:

a third material disposed in at least a portion of the channel, wherein the third material is a heterogeneous composite material and is different from the first and second materials; and said third material is exposed by a second opening positioned near a top line of the body portion.

20. The golf club head of claim 19, wherein the third material has a lesser density than the first and second materials and the second material has a greater density than the first material.

* * * * *